US007425170B1

(12) United States Patent
Herbert et al.

(10) Patent No.: US 7,425,170 B1
(45) Date of Patent: Sep. 16, 2008

(54) ARMATURE FOR A BRASSIERE

(75) Inventors: Victor Alan Herbert, Winchelsea (GB); Stewart Chapman, Conventry (GB)

(73) Assignee: Jockey International, Inc., Kenosha, WI (US)

( * ) Notice: Subject to any disclaimer, the term of this patent is extended or adjusted under 35 U.S.C. 154(b) by 0 days.

(21) Appl. No.: 11/767,079

(22) Filed: Jun. 22, 2007

(51) Int. Cl.
*A41C 3/10* (2006.01)
*A41C 3/12* (2006.01)

(52) U.S. Cl. ..... 450/41; 2/255

(58) Field of Classification Search ..... 450/41–52, 450/80; 2/255–264
See application file for complete search history.

(56) References Cited

U.S. PATENT DOCUMENTS 4,133,316 A 1/1979 Schwartz
4,153,062 A 5/1979 Delet
4,235,240 A 11/1980 Cousins
4,275,740 A 6/1981 Weston
4,777,668 A 10/1988 Weston
5,141,470 A 8/1992 Morgan et al.
5,527,202 A 6/1996 Morgan et al.
5,730,641 A * 3/1998 Brown ..... 450/41
5,749,767 A 5/1998 Arceo
5,820,444 A 10/1998 McGaughey
5,830,040 A 11/1998 Morgan et al.
5,934,970 A 8/1999 Morgan et al.
5,967,877 A 10/1999 Howard
6,053,800 A 4/2000 Lattanzi
6,152,802 A 11/2000 Horta et al.
6,206,753 B1 3/2001 Werner
6,346,028 B1 * 2/2002 Fildan et al. ..... 450/41
6,375,538 B1 4/2002 Allen et al.
6,383,055 B2 5/2002 Valentin
6,431,946 B1 8/2002 Fildan et al.
6,439,960 B1 * 8/2002 Fildan et al. ..... 450/41
6,468,130 B1 10/2002 Thakur et al.
6,485,352 B1 11/2002 Batcha et al.
6,575,811 B1 6/2003 Fildan et al.

(Continued)

FOREIGN PATENT DOCUMENTS

WO 2006/091401 A2 8/2006
WO 2007/035781 A2 3/2007

OTHER PUBLICATIONS

Fildan Accessories, 3d swing-wire, Ref. WA 138A-02, Information sheets available at http://www.fildan.com/www/index.php?cat_id=1000045, at least as of Jan. 8, 2008.

(Continued)

*Primary Examiner*—Gloria Hale
(74) *Attorney, Agent, or Firm*—Michael Best & Friedrich LLP

(57) ABSTRACT

An armature for a brassiere for a woman have a chest area. A breast projecting from the breast area and a transition area transitioning between the chest area and proximal, intermediate, and distal portions of the breast. The transition area defines a continuous contour. The armature includes an underwire having a distal portion configured to be positioned adjacent the distal portion of the breast, a proximal portion configured to be positioned adjacent the proximal portion of the breast, and an intermediate portion configured to be positioned adjacent the intermediate portion of the breast. The underwire has an unsprung state configured to match the contour of the transition area.

17 Claims, 7 Drawing Sheets

U.S. PATENT DOCUMENTS

| | | | |
|---|---|---|---|
| 6,780,080 | B2 | 8/2004 | Horta et al. |
| 6,857,933 | B2 | 2/2005 | Horta et al. |
| 7,112,117 | B2 | 9/2006 | Horta et al. |
| 7,234,994 | B2 | 6/2007 | Fildan et al. |
| 2003/0060125 | A1 | 3/2003 | Boser |
| 2004/0058617 | A1 | 3/2004 | Li |
| 2005/0197043 | A1 | 9/2005 | Horta et al. |
| 2007/0087660 | A1 | 4/2007 | Fildan et al. |
| 2007/0264905 | A1 | 11/2007 | Horta et al. |

OTHER PUBLICATIONS

Fildan Accessories, Needle wires, Information sheets available at http://www.fildan.com/www/index.php?cat_id =1000046, at least as of Jan. 8, 2008.

Fildan Accessories, Push & Zip up wire, Information sheets available at http://www.fildan.com/www/index.php?cat_id=1000085, at least as of Jan. 8, 2008.

H.-Y.Hyun-Young Lee, Kyunghi Hong and Eun Ae Kim, Measurement Protocol of Women's Nude Breasts Using a 3D Scanning Technique, Applied Ergonomics, Jul. 2004, pp. 353-359, vol. 35, Issue 4; Korea Research Foundation (KRF-2000-042-D00129).

Hyun-Young Lee, Kyunghi Hong, Optimal Brassiere Wire Based on the 3D Anthropometric Measurements of Under Breast Curve, Applied Ergonomics 38 (2007) pp. 377-384, Basic Research Program of the Korea Science & Engineering Foundation (R04-2000-000-00087-0).

* cited by examiner

ARMATURE FOR A BRASSIERE

FIELD OF THE INVENTION

The present invention relates to women's support undergarments, and more particularly to an armature support arrangement for a women's brassiere.

BACKGROUND OF THE INVENTION

Brassieres are commonly worn by women under their clothing to support their breasts. A brassiere, more commonly known to consumers as a bra, typically includes cups to support the breasts and wing portions that attach to the cups and encircle the upper torso of the woman to hold the bra on the woman's body. Some bra designs also utilize an armature, or flexible wire under the cups, to provide additional support for the breasts. However, some underwire configurations can lead to pinching, digging, and other discomfort after the bra is fastened to the woman's body due in part to an underwire that is not specifically formed to fit the user's breast. Additionally, some underwire and wing configurations can lead to unattractive bulging of the cup when the bra is worn by the woman. It is thus desirable to provide an underwire bra design that is configured to minimize pinching and discomfort of the wearer, as well as provide a better fit and appearance when worn by a woman.

SUMMARY OF THE INVENTION

In one embodiment, the invention provides an armature for a brassiere for a woman having a chest area, a breast projecting from the breast area, and a transition area transitioning between the chest area and proximal, intermediate, and distal portions of the breast. The transition area defines a continuous contour. The armature includes an underwire having a distal portion configured to be positioned adjacent the distal portion of the breast, a proximal portion configured to be positioned adjacent the proximal portion of the breast, and an intermediate portion configured to be positioned adjacent the intermediate portion of the breast. The underwire has an unsprung state configured to match the contour of the transition area.

In another embodiment, the invention provides a brassiere including an armature. The armature includes a flat surface defining a face having a width, wherein the face is oriented toward a transition area.

In another embodiment, the invention provides a brassiere for a woman having a chest area, a breast projecting from the breast area, and a transition area transitioning between the chest area and proximal, intermediate, and distal portions of the breast. The transition area defines a continuous contour. The brassiere includes a cup configured to support the breast, a wing attached to the cup, the wing adapted to extend around to a back of the woman, and an armature at least partially attached to the cup and wing. The armature has a distal portion configured to be positioned adjacent the distal portion of the breast, a proximal portion configured to be positioned adjacent the proximal portion of the breast, and an intermediate portion configured to be positioned adjacent the intermediate portion of the breast. The armature has an unsprung state configured to match the contour of the transition area.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
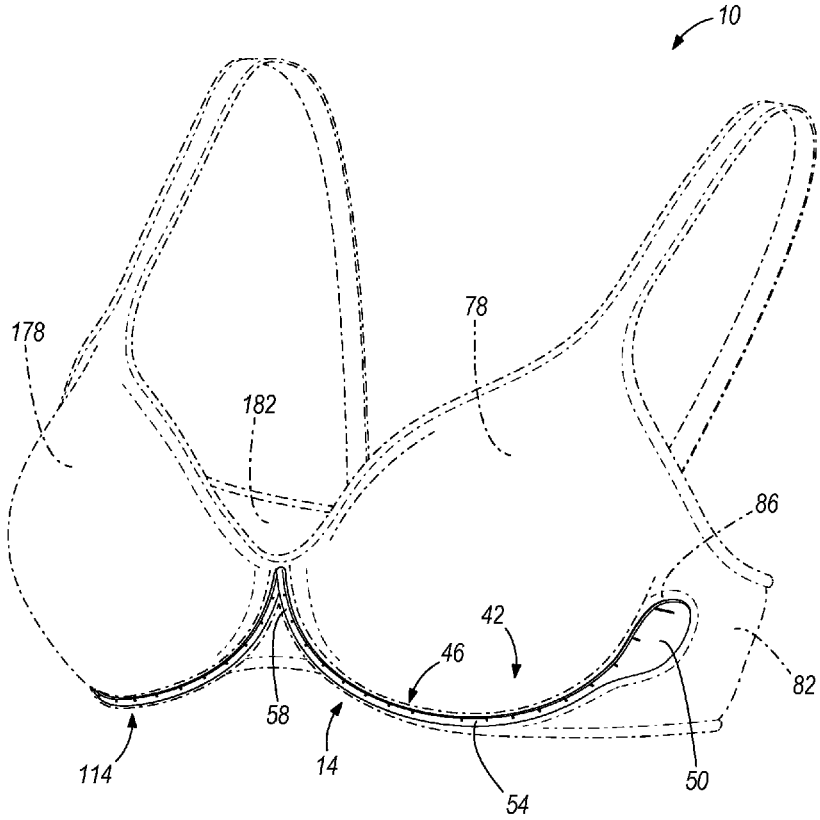
FIG. 1 illustrates a brassiere embodying an armature of the present invention.
Figure 2:
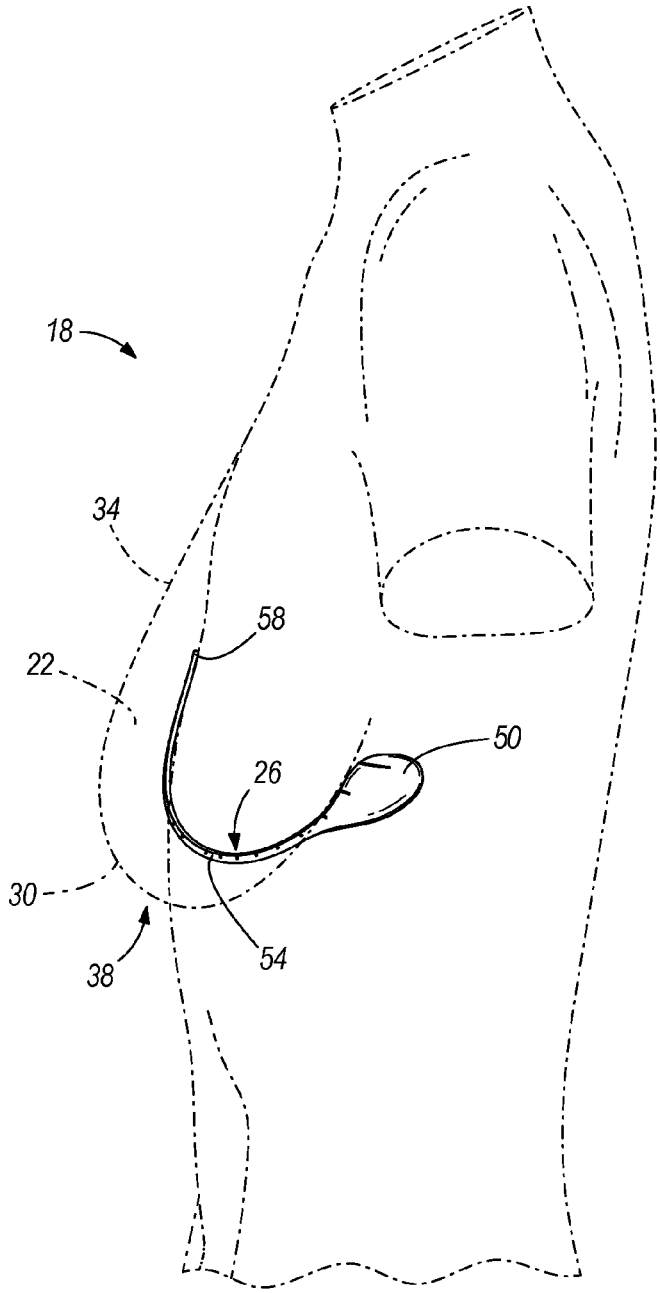
FIG. 2 is a side view of an armature of the present invention as shown on a female user.
Figure 3:
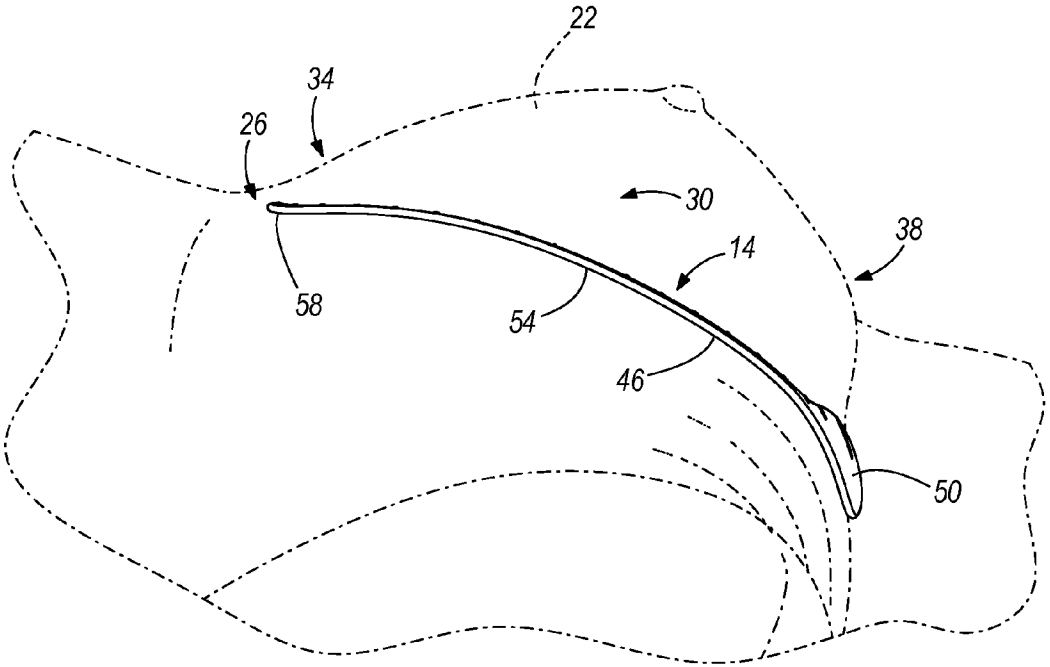
FIG. 3 is a bottom view of an armature of the present invention as shown on a female user.
Figure 4:
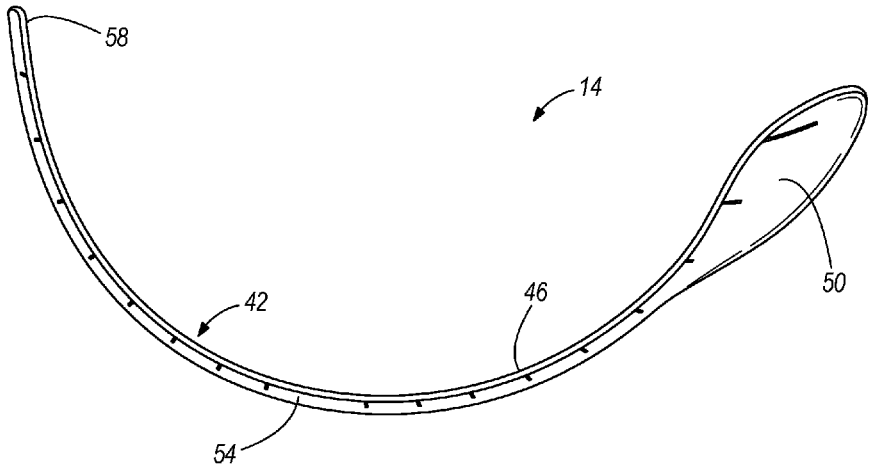
FIG. 4 is a front view of an armature of the present invention.
Figure 5:
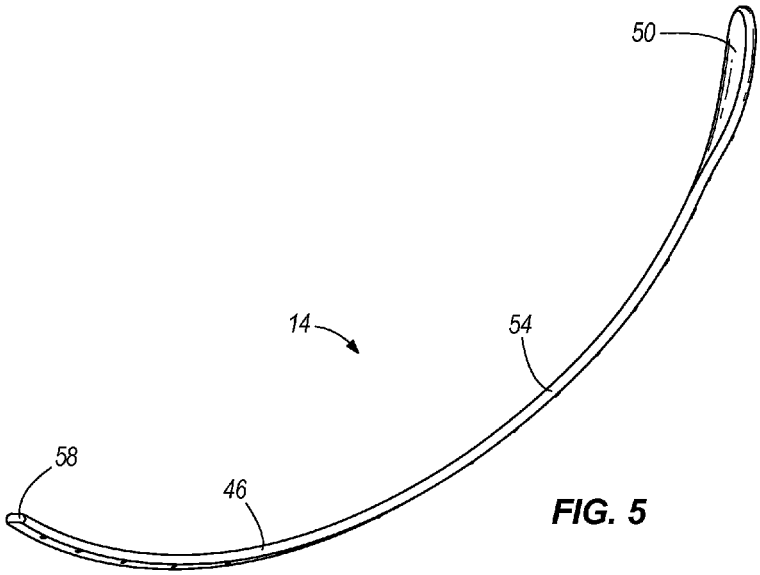
FIG. 5 is a top view of an armature of the present invention.

FIG. 1 illustrates a brassiere 10 embodying an armature 14 of the present invention. The brassiere 10 is adapted for use on a woman having a chest area 18 with at least one breast 22 projecting from the chest area 18. The chest area 18 further has a transition area 26, or an inframammary fold, where the chest area 18 transitions to the breast 22. The breast 22 has a proximal breast portion 34, an intermediate breast portion 30 and a distal breast portion 38. The proximal breast portion 34 is the portion of the breast 22 that lies adjacent to the sternum, or the median line of the female body. The distal breast portion 38 is the portion of the breast 22 distal, or away from, the sternum. The intermediate breast portion 30 is the portion of the breast 22 that lies intermediate to the proximal breast portion 34 and distal breast portion 38. The transition area 26 further defines a continuous contour on the female body which lies outside of a single plane. The transition area 26 is such that the area is not flat, but rather follows the natural contour of the human body, including bone, muscle, fat and skin.

The brassiere 10 further includes a cup 78 and a wing 82. The cup 78 is configured to support the breast 22. The wing 82 is coupled to the cup 78 and adapted to extend around to a back of the woman. Although not shown, the brassiere can be configured to lock or latch in a rear of the woman, in ways including, but not limited to a snap, a hook and eye, a latch, or the like. In some embodiments, the brassiere is configured to lock or latch in a front of the woman in similar ways to a rear lock or latch. The armature 14 is at least partially attached to the cup 78 and the wing 82. In some embodiments, the armature 14 is partially attached to the cup 78 and the wing 82 by way of a fabric pocket 86 formed into the brassiere 10. The fabric pocket 86 is adapted to receive and retain the armature 14. The fabric pocket 86 can be any shape or material that can receive and retain the armature 14.

A typical brassiere 10 is adapted to include a first cup 78 and a second cup 178. The first cup 78 and second cup 178 are substantially identical mirror images of each other and thus only the first cup 78 will be discussed below. Similarly, a typical brassiere 10 will have a first wing 82, a second wing 182, a first armature 14 and a second armature 114. Accordingly, only the first wing 82 and first armature 14 will be discussed below.

As illustrated in FIGS. 2-5, the armature 14 is an underwire 46 that includes a distal end portion 50, a proximal end portion 58 and an intermediate portion 54. The distal end portion 50 is configured to be positioned adjacent the distal breast portion 38. The distal end portion 50 can be a spoon shape to prevent the breast 22 from pushing into the wing 82. The distal end portion 50 is illustrated as a spoon shape, but the distal end portion 50 can be any shape adapted to prevent the breast 22 from pushing into the wing 82. The proximal end portion 58 is configured to be positioned adjacent the proximal breast portion 34. The intermediate portion 54 is configured to be positioned adjacent the intermediate breast portion 30, or a lower breast portion.

Figure 6:
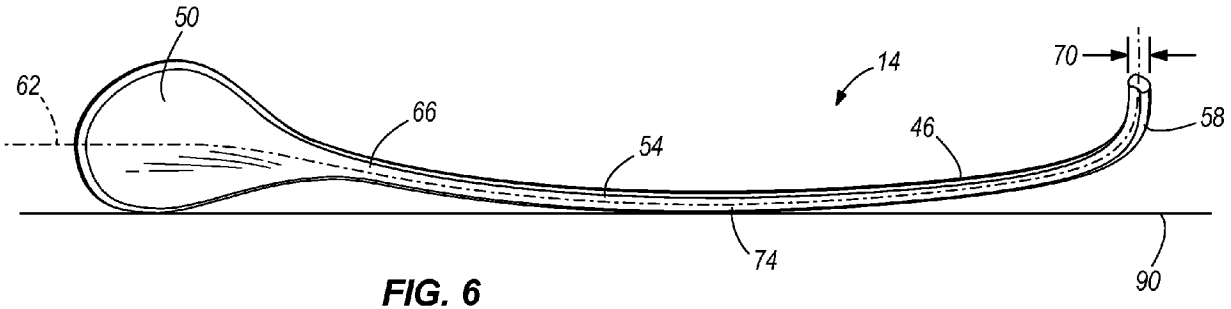
FIG. 6 is another top view of the armature of the present invention as shown lying on a flat surface.
Figure 7:
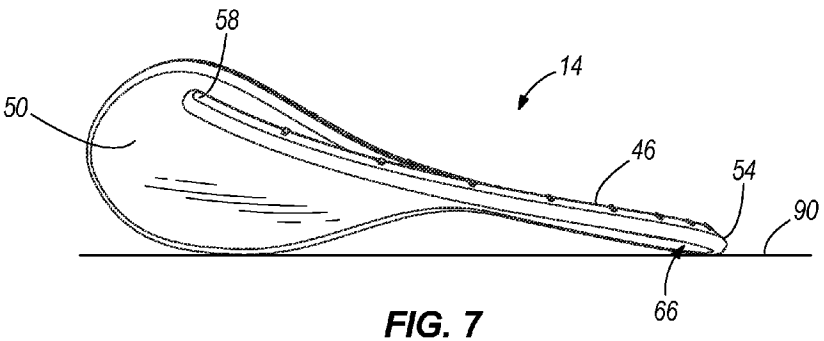
FIG. 7 is a side view of the armature of the present invention as shown lying on a flat surface.

As illustrated in FIGS. 6 and 7, the armature 14 has an unsprung shape, wherein the armature 14 is configured to match the contour of the transition area 26. As seen in FIG. 6, an intermediate axis 62 lies through an intermediate line of the armature 14 and which does not lie in a single plane. Rather, the intermediate axis 62 follows the unsprung state of the armature 14 and is configured to follow the natural curvature of the female body along the transition area 26. The sprung and unsprung configurations of the armature were extrapolated from a database created by three-dimensionally scanning a model. This shape allows the brassiere to properly position the armatures comfortably against the transition areas of the woman's body and to firmly press the cups against the breasts.

Figure 8:
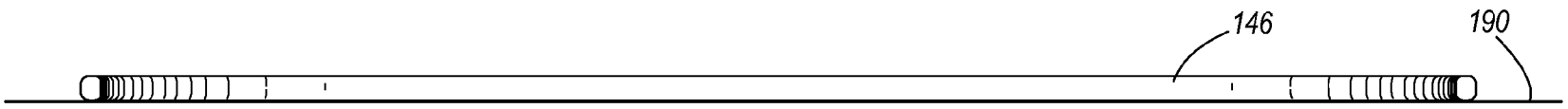
FIG. 8 PRIOR ART
FIG. 8 is a top view of a prior art underwire.
Figure 9:
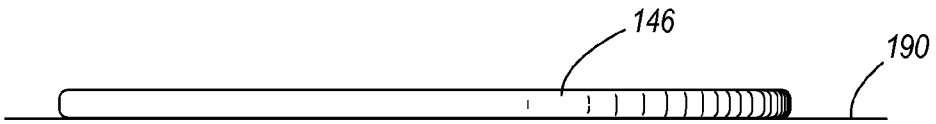
FIG. 9 PRIOR ART
FIG. 9 is a side view of the prior art underwire of FIG. 8.
Figure 10:
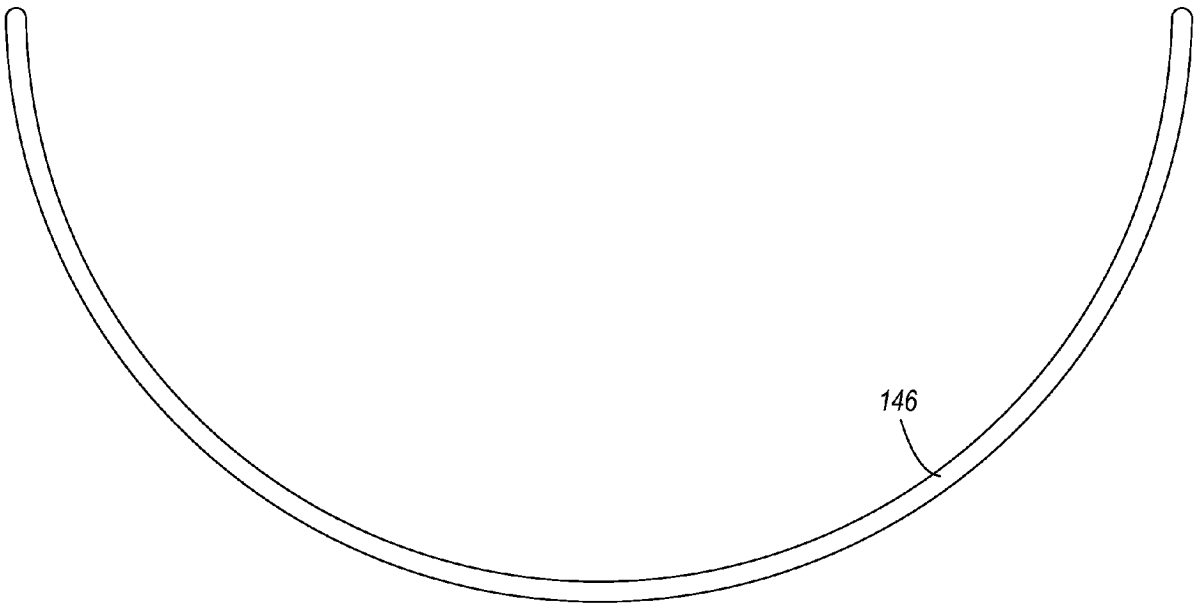
FIG. 10 PRIOR ART
FIG. 10 is a plan view of the prior art underwire of FIG. 8.

To illustrate the unsprung state and multi-dimensional nature of the armature, FIGS. 8-10 illustrate and contrast a prior art underwire 146 that lies in a single plane such that the prior art underwire 146 does not conform to the natural curvature of the female body in the unsprung state. As illustrated in FIGS. 8 and 9, the prior art underwire 146 lies flat on the ground 190, or in a single plane. As contrasted to FIGS. 6 and 7, the armature 14 of the present invention does not lie flat on the ground 90, but rather lies outside of a single plane.

As further illustrated in FIG. 6, the armature 14 includes a flat surface 66 having a width 70 and defining a face 74. In some embodiments, the width of the face is at least 0.5 mm. In other embodiments, the width of the face is approximately 0.5 mm to 2.0 mm. The flat surface 66 further conforms to the contour of the transition area 26. The flat surface 66 enables a comfortable fit of the armature 14 against the female body.

The brassiere can be manufactured of any fabric or material suitable for use in a garment to be worn against the body, and in most cases the unclothed body, of a human user. The armature can be manufactured from any resin or polymer which has material properties suitable for forming an armature for a brassier, such as including but not limited such material properties as high impact resistance, good flowability, and variable E-modulus.

Additionally, the armature can be formed in a plurality of sizes to fit a plurality of sizes of brassiere wearers.

Various features and advantages of the invention are set forth in the following claims.

What is claimed is:

1. An armature for a brassiere for a woman have a chest area, a breast projecting from the chest area, and a transition area transitioning between the chest area and a proximal portion, an intermediate portion, and a distal portion of the breast, the transition area defining a continuous contour, the armature comprising:

an underwire having a distal portion configured to be positioned adjacent the distal portion of the breast, a proximal portion configured to be positioned adjacent the proximal portion of the breast, and an intermediate portion configured to be positioned adjacent the intermediate portion of the breast, the underwire having an unsprung state configured to match the contour of the transition area.

2. The armature of claim 1, wherein the underwire defines an intermediate axis.

3. The armature of claim 2, wherein the intermediate axis lies outside of a single plane.

4. The armature of claim 2, wherein the intermediate axis conforms to the transition area.

5. An armature for a brassiere, the armature comprising:

an underwire having a flat surface, the flat surface having a width and defining a face, wherein the flat surface faces a transition area, the transition area transitioning between a chest area and a breast projecting from the chest area; and wherein the flat surface is defined in cross-section by a plane normal to an intermediate axis of the underwire.

6. The armature of claim 5, wherein the width of the face is at least 0.5 mm.

7. The armature of claim 5, wherein the width of the face is approximately 0.5 mm to 2 mm.

8. The armature of claim 5, wherein the face lies against the transition area.

9. A brassiere for a woman having a chest area, a breast projecting from the chest area, and a transition area transitioning between the chest area and a proximal portion, an intermediate portion, and a distal portion of the breast, the transition area defining a continuous contour, the brassiere comprising:

a cup configured to support the breast;

a wing attached to the cup, the wing adapted to extend around to a back of the woman; and an armature at least partially attached to the cup and wing, the armature having a distal portion configured to be positioned adjacent the distal portion of the breast, a proximal portion configured to be positioned adjacent the proximal portion of the breast, and an intermediate portion configured to be positioned adjacent the intermediate portion of the breast, the armature having an unsprung state configured to match the contour of the transition area.

10. The brassiere of claim 9, wherein the armature defines an intermediate axis.

11. The brassiere of claim 10, wherein the intermediate axis lies outside of a single plane.

12. The brassiere of claim 10, wherein the intermediate axis conforms to the transition area.

13. The brassiere of claim 9, further comprising a fabric pocket, the fabric pocket conforming to the transition area and adapted to receive and retain the armature.

14. A brassiere for a woman having a chest area, a breast projecting from the chest area, and a transition area transitioning between the chest area and a proximal portion, an intermediate portion, and a distal portion of the breast, the transition area defining a continuous contour, the brassiere comprising:

a cup configured to support the breast;

a wing attached to the cup, the wing adapted to extend around to a back of the woman; and an armature at least partially attached to the cup and wing, the armature having a distal portion configured to be positioned adjacent the distal portion of the breast, a proximal portion configured to be positioned adjacent the proximal portion of the breast, and an intermediate portion configured to be positioned adjacent the intermediate portion of the breast, the armature comprising an underwire having a flat surface defining a face having a width, wherein the face is oriented toward the transition area;

wherein the flat surface is defined in cross-section by a plane normal to an intermediate axis of the underwire.

15. The brassiere of claim 14, wherein the width of the face is at least 0.5 mm.

16. The brassiere of claim 14, wherein the width of the face is approximately 0.5 mm to 2 mm.

17. The brassiere of claim 14, wherein the face lies against the transition area.

* * * * *

UNITED STATES PATENT AND TRADEMARK OFFICE

CERTIFICATE OF CORRECTION

PATENT NO. : 7,425,170 B1
APPLICATION NO. : 11/767079
DATED : September 16, 2008
INVENTOR(S) : Victor Alan Herbert and Stewart Chapman It is certified that error appears in the above-identified patent and that said Letters Patent is hereby corrected as shown below:

On the face of the patent at (57), word correction in the first sentence of the Abstract: "have" should be "having"

Claim 1, column 3, line 65: "have" should be "having"

Signed and Sealed this

Second Day of June, 2009

JOHN DOLL
*Acting Director of the United States Patent and Trademark Office*

US007425170C1

(12) EX PARTE REEXAMINATION CERTIFICATE (9195th)

United States Patent
Herbert et al.

(10) Number: US 7,425,170 C1
(45) Certificate Issued: Aug. 14, 2012

(54) ARMATURE FOR A BRASSIERE

(75) Inventors: Victor Alan Herbert, Winchelsea (GB); Stewart Chapman, Conventry (GB)

(73) Assignee: Jockey International, Inc., Kenosha, WI (US)

Reexamination Request:
No. 90/012,005, Nov. 8, 2011

Reexamination Certificate for:

| | |
|---|---|
| Patent No.: | **7,425,170** |
| Issued: | **Sep. 16, 2008** |
| Appl. No.: | **11/767,079** |
| Filed: | **Jun. 22, 2007** |

Certificate of Correction issued Jun. 2, 2009.

(51) Int. Cl.
*A41C 3/10* (2006.01)
*A41C 3/12* (2006.01)

(52) U.S. Cl. ..... 450/41; 2/255
(58) Field of Classification Search ..... None
See application file for complete search history.

(56) References Cited

To view the complete listing of prior art documents cited during the proceeding for Reexamination Control Number 90/012,005, please refer to the USPTO's public Patent Application Information Retrieval (PAIR) system under the Display References tab.

*Primary Examiner*—Patricia Engle

(57) ABSTRACT

An armature for a brassiere for a woman having a chest area. A breast projecting from the breast area and a transition area transitioning between the chest area and proximal, intermediate, and distal portions of the breast. The transition area defines a continuous contour. The armature includes an underwire having a distal portion configured to be positioned adjacent the distal portion of the breast, a proximal portion configured to be positioned adjacent the proximal portion of the breast, and an intermediate portion configured to be positioned adjacent the intermediate portion of the breast. The underwire bra has an unsprung state configured to match the contour of the transition area.

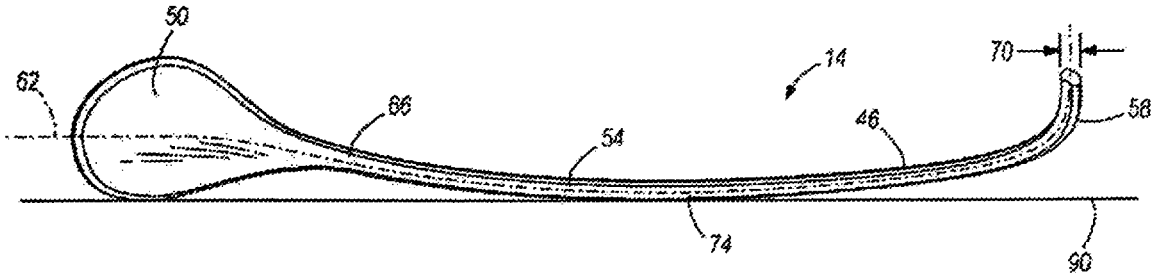

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-4 and 9-13 is confirmed.

Claims 8 and 17 are cancelled.

Claims 5 and 14 are determined to be patentable as amended.

Claims 6, 7, 15 and 16, dependent on an amended claim, are determined to be patentable.

New claims 18 and 19 are added and determined to be patentable.

1. An armature for a brassiere for a woman having a chest area, a breast projecting from the chest area, and a transition area transitioning between the chest area and a proximal portion, an intermediate portion, and a distal portion of the breast, the transition area defining a continuous contour, the armature comprising:

an underwire having a distal portion configured to be positioned adjacent the distal portion of the breast, a proximal portion configured to be positioned adjacent the proximal portion of the breast, and an intermediate portion configured to be positioned adjacent the intermediate portion of the breast, the underwire having an unsprung state configured to match the contour of the transition area.

5. An armature for a brassiere, the armature comprising:

an underwire having a flat surface, the flat surface having a width and defining a face, wherein the flat surface faces a transition area, the transition area transitioning between a chest area and a breast projecting from the chest area; [and]

wherein the flat surface is defined in cross-section by a plane normal to an intermediate axis of the underwire [.]; *and*

*wherein the face lies against the transition area*.

14. A brassiere for a woman having a chest area, a breast projecting from the chest area, and a transition area transitioning between the chest area and a proximal portion, an intermediate portion, and a distal portion of the breast, the transition area defining a continuous contour, the brassiere comprising:

a cup configured to support the breast;

a wing attached to the cup, the wing adapted to extend around to a back of the woman; and an armature at least partially attached to the cup and wing, the armature having a distal portion configured to be positioned adjacent the distal portion of the breast, a proximal portion configured to be positioned adjacent the proximal portion of the breast, and an intermediate portion configured to be positioned adjacent the intermediate portion of the breast, the armature comprising an underwire having a flat surface defining a face having a width, wherein the face is oriented toward the transition area;

wherein the flat surface is defined in cross-section by a plane normal to an intermediate axis of the underwire [.]; *and*

*wherein the face lies against the transition area*.

*18. The armature of claim 5, wherein the underwire follows the contour of the transition area.*

*19. The brassiere of claim 14, wherein the armature follows the contour of the transition area.*

* * * * *